US009121076B2

(12) United States Patent
Smith et al.

(10) Patent No.: US 9,121,076 B2
(45) **Date of Patent: *Sep. 1, 2015**

(54) STAVE AND BRICK CONSTRUCTIONS HAVING REFRACTORY WEAR MONITORS AND IN PROCESS THERMOCOUPLES

(75) Inventors: Todd G. Smith, Harmony, PA (US); Derek S. Dengel, Harmony, PA (US)

(73) Assignee: Berry Metal Company, Harmony, PA (US)

( * ) Notice: Subject to any disclaimer, the term of this patent is extended or adjusted under 35 U.S.C. 154(b) by 187 days.

This patent is subject to a terminal disclaimer.

(21) Appl. No.: 13/546,385

(22) Filed: Jul. 11, 2012

(65) Prior Publication Data

US 2013/0181384 A1 Jul. 18, 2013

Related U.S. Application Data

(63) Continuation-in-part of application No. 13/147,929, filed as application No. PCT/US2010/041414 on Jul. 8, 2010.

(60) Provisional application No. 61/223,745, filed on Jul. 8, 2009, provisional application No. 61/231,477, filed on Aug. 5, 2009, provisional application No. 61/507,500, filed on Jul. 13, 2011.

(51) Int. Cl.

| | |
|---|---|
| ***C21B 7/06*** | (2006.01) |
| ***F27D 1/00*** | (2006.01) |
| ***C21B 7/10*** | (2006.01) |
| ***C21B 7/24*** | (2006.01) |
| ***F27D 1/04*** | (2006.01) |
| *F27D 21/00* | (2006.01) |

(52) U.S. Cl.

CPC ... *C21B 7/06* (2013.01); *C21B 7/10* (2013.01); *C21B 7/24* (2013.01); *F27D 1/0003* (2013.01); *F27D 1/04* (2013.01); *F27D 21/0021* (2013.01); *F27D 21/0014* (2013.01)

(58) Field of Classification Search

CPC ..... C21B 7/06; F27D 1/0003

USPC ..... 266/78, 99, 280

See application file for complete search history.

(56) References Cited

U.S. PATENT DOCUMENTS

| | | | | |
|---|---|---|---|---|
| 5,117,604 | A * | 6/1992 | Bly et al. | 52/509 |
| 2009/0126306 | A1 * | 5/2009 | Jonville et al. | 52/506.02 |

FOREIGN PATENT DOCUMENTS

| | | | |
|---|---|---|---|
| SU | 1477745 | A * | 5/1989 |

* cited by examiner

*Primary Examiner* — Scott Kastler

(74) *Attorney, Agent, or Firm* — Paul D. Bangor, Jr.; Clark Hill PLC

(57) ABSTRACT

A stave/brick construction, comprising: a stave having a plurality of ribs and a plurality of channels, wherein a front face of the stave defines a first opening into each of the channels; a plurality of bricks wherein each brick is insertable into one of the plurality of channels via its first opening to a position, upon rotation of the brick, partially disposed in the one channel such that one or more portions of the brick at least partially engage one or more surfaces of the one channel and/or of a first rib of the plurality of ribs whereby the brick is locked against removal from the one channel through its first opening via linear movement without first being rotated; and one or more wear monitors and/or thermocouples, wherein each wear monitor and thermocouple is disposed through or adjacent to the stave and/or one or more of the bricks.

21 Claims, 8 Drawing Sheets

STAVE AND BRICK CONSTRUCTIONS HAVING REFRACTORY WEAR MONITORS AND IN PROCESS THERMOCOUPLES

CROSS REFERENCE TO RELATED APPLICATIONS

This application claims the benefit of provisional patent application U.S. Ser. No. 61/507,500 filed Jul. 13, 2011, by the present inventor entitled Refractory Wear Monitors And In Process Thermocouples Installed In Stave System To Optimize Operations which is incorporated by reference herein for all purposes. This application is a continuation in part of U.S. patent application Ser. No. 13/147,929 filed Dec. 23, 2011 currently pending, which claims the benefit of (1) PCT Patent Application No. PCT/US 10/41414 filed Jul. 8, 2010, (2) provisional patent application U.S. Ser. No. 61/223,745 filed Jul. 8, 2009, by the present inventor, which is incorporated by reference herein for all purposes and (3) provisional patent application U.S. Ser. No. 61/231,477 filed Aug. 5, 2009, by the present inventor, which is incorporated by reference herein for all purposes.

TECHNICAL FIELD OF THE INVENTION

This invention relates generally to apparatus and methods for constructing and installing bricks, such as refractory bricks, in frames, staves and/or coolers in blast furnaces or other metallurgical furnaces. Related fields include systems and methods for cooling blast furnaces and other metallurgical furnaces. Related fields include cooling plates and cooling staves. This invention also relates generally to apparatus and methods for monitoring the wear of refractory, refractory bricks in frames, staves and/or coolers in blast furnaces or other metallurgical furnaces. The furnace wear monitor aspect of the invention includes a monitor and thermocouple probes embedded in refractory coupled with comparative laser optical scans of the refractory surface on the interior of the furnace.

BACKGROUND

Field of the Disclosure

Conventional designs and constructions for cooling refractory bricks in blast furnaces and other metallurgical furnaces include cooling staves. Conventional copper cooling staves are generally planar, rectangularly shaped and arranged within a furnace substantially parallel or as parallel as possible, given the shapes of the staves and/or the interior of the furnace, to the metal shell of the furnace. The cooling staves typically cover a high percentage of the inner surface of the metal shell of the furnace. Refractory lining, such as refractory bricks, may be disposed in, on or around the surface of the stave, such as, for example, bricks disposed within slots or channels defined by the stave. Staves also have cavities that provide passages or house internal piping. Such passages or piping are connected to one or more external pipes that extend from the furnace shell side of the stave and penetrate the metal shell of the furnace. Coolant, such as, for example, water at an elevated pressure is pumped through the pipes and passages in order to cool the stave. The cooled stave thus cools the refractory bricks disposed within slots or channels defined by the stave.

Current stave or cooling panel brick designs typically are installed in grooves or channels in the cooler before installing the cooling stave/panel in the furnace. Further, many conventional refractory bricks are designed to be installed in a flat stave or cooler. When using flat or curved staves/coolers with pre-installed bricks, the staves are installed in the furnace and have a ram gap in between each pair of adjacent staves to allow for construction deviation. These ram gaps are then filled with refractory material to close the gap between the stave/brick constructions on the sides of the gap. This refractory filled ram gap typically is a weak point in a furnace lining comprising conventional stave/brick constructions. During furnace operation, the ram gap often erodes prematurely and furnace gases track between the staves. Moreover, such conventional stave/brick constructions leave brick edges protruding into the furnace which are exposed to matter and other debris falling through the furnace. Such protruding brick edges tend to wear out more frequently than non-protruding edges, leading to broken or crumbled bricks that may fall through the furnace causing further damage to the furnace lining. Such broken bricks also expose the stave thereby causing it to be damaged or worn out prematurely.

Current stave or cooling panel bricks are typically either installed in straight grooves employed as the main method of attachment to keep the bricks in the cooler or tapered to force bricks which are not locked in grooves in the stave to push against the cooler when the bricks are heated during furnace operation.

Also, in recent years, it has been a common practice to install staves without refractory in front of them and try to form a skull layer to protect and insulate the stave in a blast furnace. This process related skull is generated and lost repeatedly in service and actually changes furnace performance. Skulls can only be formed in the cohesive zones of the furnace. Therefore, this skull approach is not effective if the cohesive zone is incorrectly determined. Additionally, the cohesive zone of the furnace changes depending on charge material and the skull adhesion is lost in sections of the furnace at different times. This results in non-uniform temperatures throughout the staves and furnace. However, an improved brick refractory lining protects the stave regardless of adhesion and would be preferable to such skull insulating process, even through in some cases it may still be desirable to form the skull to protect the improved refractory.

Current locked-in brick designs, such as dovetailed bricks in complementary-shaped stave channels, are relatively thin throughout their vertical thickness. Such thin-necked bricks are susceptible to cracking at the thin neck portion thereby creating brick fragments and pieces falling into the furnace which may hit and damage other bricks and staves of the furnace lining.

Many older stave designs which incorporate bricks in front of the stave employ multiple rows or layers of bricks in front of the stave. Such constructions contain joints which further prevent effective cooling of the bricks farthest from the stave.

There are several types of existing refractory thickness monitors. U.S. Pat. No. 4,269,397 to Strimple, et al. describes a series of prior art devices that are limited to measuring fixed thicknesses of the refractory. A first is dependent upon the position of a particular wire or loop in the refractory. These types of devices are also susceptible to being "shorted-out" by slag penetration, breakage due to spalling of the refractory, and deterioration of the sheath and insulating material placed between the wires and the sheath. Further the wear monitors are required to be placed at a variety of different positions in the refractory at different depths to detect "changes" in depth. Another known method is to embed low level radiation sources such as radioactive isotopes in the refractory and measure the change in radiation emission over time—a decrease in emission indicates refractory wear. Strimple's monitor discloses the use of a conductor and sheath made from any electrically conductive metal capable of withstanding the hostile environments prevalent in metallurgical apparatus, for example a blast furnace, basic oxygen furnace or an electric furnace. The refractory monitor determines changes in refractory thickness by detecting the impedance variations dependent upon the capacitance between the conductor and the sheath and is dependent on the dielectric constant to function. Therefore, this monitor must undergo extensive customization and the dielectric constant of the refractory material must be balanced with the monitor. There are also known optical scanning methods of mapping the refractory of the interior of blast furnaces that employ lasers with optical detectors capable of detecting scattered laser rays.

When the refractory begins to wear out and allows hot metal to come into contact with the steel shell of the furnace, the hot metal will wear though shell potentially causing catastrophic disaster to occur in the form of a furnace blowout. A blast furnace blowout can be devastating to both lives and property. Blowouts can be caused when molten metal begins to seep through cracks in the refractory layer and through the skin of the vessel. The cracks can be caused by normal wear of the refractory layer or though unexpected damage from impact. The temperature of molten metal is in excess of 1000° C. (1832° F.) and the interior temperatures of certain furnaces can reach up to 2200° C. (4000° F.). When a blowout occurs it can allow the molten metal to flow like water from the furnace causing the destruction of nearly everything in its path. Such blowouts can kill or severely hurt furnace workers. Moreover, blowouts can cause the closure of mills for many months putting people out of work while mills are repaired or rebuilt, additionally even completely closing mills if the disaster is severe enough.

Experience with blast furnaces and other metallurgical furnaces have demonstrated that there are areas in the furnaces that exhibit heavier wear than other areas, these areas are known as the critical wear areas. The upper stack of the furnace with its relatively low temperatures will not wear as readily as the lower stack area and bottom area. The lower stack area and bottom area wear more because these locations are where the iron oxides go through purifying reactions and begin to soften then melt and finally trickle as liquid iron through the coke to the bottom of the furnace. This middle and bottom region of the furnace are particularly susceptible to wear and eventual failure if the wear is not detected. Nonetheless, wear can occur anywhere inside the blast furnace. It is impracticable and financially prohibitive for blast furnaces to be shut down at regular intervals so that furnace refractory can be manually measured and rebuilt accordingly. The cost benefit of operating a furnace demands it to be kept in-service for as long as safety permits. Determining where a problem may develop with the refractory in order to effect a repair before an accident takes place is also in the best interests of the mill because it saves overall repair costs and prevents catastrophic events that can close a mill for months on end and reduces the costs associated with the casualties associated with blow out events. Therefore, it is desirable to monitor the critical wear regions of the furnace refractory and also determine whether there is abnormal wear in non-critical wear regions with reasonable expense.

The present invention is directed to a technology for measuring the thickness of refractory wall in a blast furnace or other type of metallurgical apparatus and, more specifically, to measuring the thickness of a refractory wall of a stave/brick construction comprising a stave having a plurality of ribs and a plurality of channels, wherein a front face of the stave defines the first opening into each of the channels and a plurality of bricks wherein each brick is insertable into one of the plurality of channels via its first opening to a position, upon rotation of the brick, partially disposed in the one channel such that one or more portions of the brick at least partially engage one or more surfaces of the one channel and/or of a first rib of the plurality of ribs whereby the brick is locked against removal from one channel through its first opening via linear movement without first being rotated.

The present invention preferably employs wear monitors comprising a central metallic conductor and an outer metallic sheath separated from the conductor by a fine close-packed insulating material having a desirable dielectric constant. The device having two ends, a refractory end and a system end. The system end may be lead to a junction box and be connected to an electrical connector means attached thereto or may be connected directly to the electrical connector means by which the device is connected to an electronic instrument which uses time-domain reflectometry techniques. The method of this invention foresees multiple electrodes being inserted around the critical wear zone of the furnace. As the refractory in the furnace erodes, the refractory end of the wear monitor end of the monitoring device also erodes at substantially the same rate as the refractory. The loss in length of the monitoring device is substantially equal to the loss of the refractory because the original thickness of the refractory and the position of the refractory end of the wear monitor can be deduced at any time from the length of the monitoring device displayed on the recording equipment. This is accomplished by subtracting the displayed length of the monitoring device from the original displayed length determined along with a suitable calibration of the recording instrument and in turn subtracting the difference determined from the known thickness of the original refractory. Alternatively said, the erosion or loss in thickness of the refractory is equal to the loss of the embedded wear monitor.

A third aspect of the present invention is providing a laser optical scan of the furnace refractory interior surface profile measuring method whereby the laser scan provides a clear mapping for determination of any significant changes that take place in non-critical wear regions by providing a laser light emitter and a receiver to scan the interior where the profile measurements are detected through triangulation methods.

As listed above, many shortcomings are associated with known stave and refractory brick constructions.

Accordingly, it would be desirable to provide a stave/brick construction in which the refractory bricks may be installed in a flat or curved stave or cooler, before or after the stave cooler is installed in a furnace. Additionally, in the event of a reworking or rebuilding of the stave/brick construction in the furnace, the refractory bricks of the present invention can be replaced or re-installed in-whole or in-part, without removing the stave or cooler from the furnace.

In addition, it would be desirable to provide a stave/brick construction which provides a continuous lining around the interior circumference of the furnace that eliminates rain gaps between the bricks of adjacent staves and thereby increases the integrity and life of the furnace lining.

Further, it would be desirable to provide a stave/brick construction ideal for use in blast furnaces in which no brick edges are exposed or protrude into the furnace to increase the life and integrity of the furnace lining.

In addition, it would be desirable to provide a stave/refractory brick construction in which the refractory bricks can be installed in a stave or cooler that is tilted on an angle with the bricks staying in the grooves in such stave or cooler and in which the bricks may be inserted and/or removed from the front face of the stave before and/or after the stave is installed in the furnace.

Furthermore, it would be desirable to provide a stave/refractory brick construction in which the refractory bricks are doubly locked into the channels in the stave (1) by complementary surfaces of the bricks and stave channels that are engaged by inserting a portion of each brick into a channel or groove in the stave and simultaneously or thereafter rotating each brick on an axis substantially parallel to a plane of the stave and/or (b) such that the bottom of the brick rotates in a direction towards or substantively towards the stave in order to engage such complementary surfaces of the channel and brick in order to secure or lock the brick into the channel chamber and prevent it from moving linearly out of the channel or groove through an opening in the front face of the stave and (2) by oblique or tapered sections of the bricks that expand when heated during furnace operation, and push against the stave or cooler to maintain an effective bond therewith thereby providing highly effective cooling of the bricks, while also holding in place any bricks that might crack or break.

Moreover, it would be desirable to provide a stave/refractory brick construction in which the stave surface temperature is uniform and which allows for more consistent furnace operation with less loss of heat to thereby reduce stresses on the furnace and staves and increase the life of both.

Further yet, it would be desirable to provide a stave/refractory brick construction utilizing bricks having an increased vertical or neck thickness to increase strength and make the bricks less susceptible to cracking while also allowing the bricks to be installed faster, with the additional weight of each brick helping to keep it in place and less susceptible to failure.

Additionally, it would be desirable to provide an improved stave/refractory brick construction having a single layer of bricks in tight contact with the stave to eliminate thermal barriers associated with conventional stave/brick constructions having multiple layers and/or multiple mortar joints.

Further still, it would be desirable to provide an improved stave/refractory brick construction in which the refractory bricks are made of differing shapes and/or materials depending upon the type of furnace and/or the installation location within the furnace.

In addition, it would be desirable to provide an improved frame/brick construction for any application where it would be advantageous to be able to (1) brick, re-brick and/or repair the frame/brick construction after the frame has been installed and/or (2) to employ the double brick locking features of the present invention for elevated temperature applications.

These and other advantages of the invention will be appreciated by reference to the detailed description of the preferred embodiment(s) that follow.

BRIEF SUMMARY OF THE INVENTION

In a first aspect, the present invention comprises a stave/brick construction, comprising: a stave having a plurality of ribs and a plurality of channels, wherein a front face of the stave defines a first opening into each of the channels; and a plurality of bricks wherein each brick is insertable into one of the plurality of channels via its first opening to a position, upon rotation of the brick, partially disposed in the one channel such that one or more portions of the brick at least partially engage one or more surfaces of the one channel and/or of a first rib of the plurality of ribs whereby the brick is locked against removal from the one channel through its first opening via linear movement without first being rotated. Preferably, the stave may define one or more side openings into each of the channels. Also, the one or more portions of the brick comprises a nose at least partially disposed in a first section of the one channel, which is preferably complementary to the nose. In addition, rotation of the brick comprises a bottom of the brick moving in a direction towards the stave.

In accordance with yet another aspect of the stave/brick construction, a first rib surface of the first rib preferably is complementary to a groove defined by a top of the brick and the first rib surface is at least partially disposed in the groove.

In accordance with yet a further aspect of the stave/brick construction, each of the plurality of bricks can be removed from its respective channel via rotation of each brick comprising a bottom of each brick moving in a direction away from the stave.

In yet a further aspect of the stave/brick construction, the stave is preferably either substantially flat or curved with respect to one or both of a horizontal axis and a vertical axis of the stave.

In yet an additional aspect of the stave/brick construction, the stave houses a plurality of pipes.

In yet a further aspect of the stave/brick construction, preferably the plurality of bricks at least partially disposed in the plurality of channels form a plurality of stacked, substantially horizontal rows of bricks protruding from the front face of the stave, where the plurality of bricks comprise exposed faces that preferably define a flat surface or uneven surface.

In accordance with yet a further aspect of the stave/brick construction, one of the bricks cannot be pulled and/or rotated out of the first opening of its respective channel when another brick is disposed in the row above and partially or completely covers the one brick.

In accordance with yet another aspect of the present invention, the stave/brick construction comprises a plurality of staves standing side-by-side with gaps between adjacent staves; wherein each stave has a plurality of ribs, a plurality of channels, and a plurality of substantially horizontal rows of bricks disposed in the plurality of channels. Preferably, the plurality of substantially horizontal rows of bricks disposed in the plurality of channels covers, in-whole or in-part, the gaps between adjacent staves. Also, the staves stand substantially vertically or at an angle other than about 90 degrees.

In yet a further aspect of the stave/brick construction, each of the plurality of bricks further defines a seat wherein the seat is at least partially disposed in a second section of the one channel and preferably the second section is complementary to the seat.

In yet an additional aspect of the stave/brick construction, each of the plurality of bricks comprises an oblique top section and an oblique bottom section, wherein each of the oblique top and bottom sections protrude from the face of the stave and preferably the oblique top and bottom sections of each brick are substantially parallel to each other.

In accordance with yet another aspect of the stave/brick construction of the present invention, the plurality of bricks at least partially disposed in the plurality of channels form a plurality of stacked, substantially horizontal rows of bricks protruding from the front face of the stave; and wherein the oblique top section of one brick is disposed substantially near, adjacent to, in partial contact with or in complete contact with the oblique bottom section of another brick immediately above the one brick.

In yet an additional aspect, the stave/brick construction of the present invention further comprises means for operatively connecting a thermocouple to the stave.

In another aspect, the present invention comprises a frame/brick construction, comprising: a frame having a plurality of ribs and a plurality of channels, wherein a front face of the frame defines a first opening into each of the channels; and a plurality of bricks wherein each brick is insertable into one of the plurality of channels via its first opening to a position, upon rotation of the brick, partially disposed in the one channel such that one or more portions of the brick at least partially engage one or more surfaces of the one channel and/or of a first rib of the plurality of ribs whereby the brick is locked against removal from the one channel through its first opening via linear movement without first being rotated. Preferably, the frame may define one or more side openings into each of the channels. Also, the one or more portions of the brick comprises a nose at least partially disposed in a first section of the one channel, which is preferably complementary to the nose. In addition, rotation of the brick comprises a bottom of the brick moving in a direction towards the frame.

In accordance with yet another aspect of the frame/brick construction, a first rib surface of the first rib preferably is complementary to a groove defined by a top of the brick and the first rib surface is at least partially disposed in the groove.

In accordance with yet a further aspect of the frame/brick construction, each of the plurality of bricks can be removed from its respective channel via rotation of each brick comprising a bottom of each brick moving in a direction away from the frame.

In yet a further aspect of the frame/brick construction, the frame is preferably either substantially flat or curved with respect to one or both of a horizontal axis and a vertical axis of the frame.

In yet a further aspect of the frame/brick construction, preferably the plurality of bricks at least partially disposed in the plurality of channels form a plurality of stacked, substantially horizontal rows of bricks protruding from the front face of the frame, where the plurality of bricks comprise exposed faces that preferably define a flat surface or uneven surface.

In accordance with yet a further aspect of the frame/brick construction, one of the bricks cannot be pulled and/or rotated out of the first opening of its respective channel when another brick is disposed in the row above and partially or completely covers the one brick.

In accordance with yet another aspect of the present invention, the frame/brick construction comprises a plurality of frames standing side-by-side with gaps between adjacent frames; wherein each frame has a plurality of ribs, a plurality of channels, and a plurality of substantially horizontal rows of bricks disposed in the plurality of channels. Preferably, the plurality of substantially horizontal rows of bricks disposed in the plurality of channels covers, in-whole or in-part, the gaps between adjacent frames. Also, the frames stand substantially vertically or at an angle other than about 90 degrees.

In yet a further aspect of the frame/brick construction, each of the plurality of bricks further defines a seat wherein the seat is at least partially disposed in a second section of the one channel and preferably the second section is complementary to the seat.

In yet an additional aspect of the frame/brick construction, each of the plurality of bricks comprises an oblique top section and an oblique bottom section, wherein each of the oblique top and bottom sections protrude from the face of the frame and preferably the oblique top and bottom sections of each brick are substantially parallel to each other.

In accordance with yet another aspect of the frame/brick construction of the present invention, the plurality of bricks at least partially disposed in the plurality of channels form a plurality of stacked, substantially horizontal rows of bricks protruding from the front face of the frame; and wherein the oblique top section of one brick is disposed substantially near, adjacent to, in partial contact with or in complete contact with the oblique bottom section of another brick immediately above the one brick.

In yet another aspect, the present invention comprises a method for assembling a stave/brick construction comprising: providing a stave in a standing position, wherein the stave has a plurality of ribs and a plurality of channels, wherein a front face of the stave defines a first opening into each of the channels; and inserting a plurality of bricks into each channel via its first opening so that a first portion of each brick enters its respective channel via its first opening; and rotating each brick so that it is partially disposed in its respective channel with its first portion at least partially engaged with one or more surfaces of its respective channel and/or of a first rib of the plurality of stave ribs whereby the brick is locked against linear movement out of the one channel through its first opening. Preferably, after inserting, the first portion of each brick is at least partially disposed in a first section of its respective channel, and the rotating of each brick comprises a bottom of the brick moving in a direction towards the stave.

In accordance with yet another aspect, the method for assembling a stave/brick construction of the present invention further comprises: removing one or more of the plurality of bricks from their respective channels via rotation of the one or more bricks comprising a bottom of each brick moving in a direction away from the stave.

In yet another aspect, the present invention comprises a brick for a stave/brick construction, comprising: a top section defining a nose contiguous with a locking side of the brick and an upper oblique section contiguous with a first face of the brick, wherein the locking side comprises the nose, a second face, a seat and a lower concave section; and a bottom defining a lower oblique section contiguous with the first face of the brick. Preferably, brick may further comprise a groove defined by the top section disposed across a width of the brick.

In accordance with yet another aspect, the brick for a stave/brick construction of the present invention, the second face extends from the nose to the seat and is opposite to the first face. Also, preferably, a height of the second face is equal to or greater than about two times a depth of the brick measured from the second face to a bottom of the groove.

In accordance with yet a further aspect of the brick for a stave/brick construction of the present invention, preferably one or both of the nose and seat may be arcuate, polygonal or angular. Also, one or both of the first and second faces of the brick preferably are substantially flat.

In yet another aspect, the present invention comprises a stave/brick construction, comprising: a stave having a plurality of ribs and a plurality of channels, wherein a front face of the stave defines a first opening into each of the channels and wherein the plurality of ribs comprises one or more short ribs each of which is shorter than one or more adjacent long ribs, wherein each short rib and at least one adjacent long rib define, at least in part, a void such that the stave defines a plurality of voids; and a plurality of bricks wherein each brick is insertable into one of the plurality of voids in a direction substantially perpendicular to the front face to a first position from which it can be slid to a second position within one of the plurality of channels. Additionally, it is desirable to integrate the aforementioned advances in stave/refractory brick technology with refractory wear monitoring system using wear monitor probes, thermocouples and laser scanning devices, designed to detect the wear of refractory, detect abnormal changes in temperature and warn of dangerous changes to the interior of the furnace refractory surface that may reflect imminent dangerous conditions.

In another aspect, the present invention comprises a stave/brick construction, comprising: a stave having a plurality of ribs and a plurality of channels, wherein a front face of the stave defines a first opening into each of the channels; a plurality of bricks wherein each brick is insertable into one of the plurality of channels via its first opening to a position, upon rotation of the brick, partially disposed in the one channel such that one or more portions of the brick at least partially engage one or more surfaces of the one channel and/or of a first rib of the plurality of ribs whereby the brick is locked against removal from the one channel through its first opening via linear movement without first being rotated; and one or more wear monitors, wherein each wear monitor is disposed through or adjacent to the stave and/or one or more of the bricks.

In accordance with another aspect of the frame/brick construction of the present invention, each of the wear monitors comprises a metallic conductor coax and an outer metallic sheath separated by refractory material.

In accordance with a further aspect of the frame/brick construction of the present invention, each of the wear monitors may be read using a time-domain reflectometer and/or time-domain reflectometry.

In another aspect, the frame/brick construction of the present invention further comprises one or more thermocouples disposed through or adjacent to the stave and/or one or more of the bricks.

In accordance with a further aspect of the frame/brick construction of the present invention, wear monitors and thermocouples are read periodically and/or automatically via computer.

In accordance with yet another aspect of the frame/brick construction of the present invention, the plurality of bricks at least partially disposed in the plurality of channels form a plurality of stacked, substantially horizontal rows of bricks protruding from the front face of the stave.

In accordance with yet a further aspect of the frame/brick construction of the present invention, one of the bricks cannot be pulled and/or rotated out of the first opening of its respective channel when another brick is disposed in the row above and partially or completely covers the one brick.

In another aspect, the frame/brick construction of the present invention further comprises a plurality of staves standing side-by-side with gaps between adjacent staves; wherein each stave has a plurality of ribs, a plurality of channels, and a plurality of substantially horizontal rows of bricks disposed in the plurality of channels.

In accordance with yet a further aspect of the frame/brick construction of the present invention, the plurality of substantially horizontal rows of bricks disposed in the plurality of channels covers, in-whole or in-part, the gaps between adjacent staves.

In another aspect, the frame/brick construction of the present invention further comprises a laser emitter/receiver for taking readings by emitting one or more laser pulses onto the stave and/or plurality of bricks and for receiving the one or more laser pulses as reflected from the stave and/or plurality of bricks, and a computer for analyzing the reflected laser pulses to determine one or more conditions of the stave and/or plurality of bricks and/or differences in the one or more conditions of the stave and/or plurality of bricks between first and second readings.

In accordance with yet a further aspect of the frame/brick construction of the present invention, the rotation of the brick comprises a bottom of the brick moving in a direction towards the stave.

In accordance with another aspect of the frame/brick construction of the present invention, the stave is substantially flat.

In accordance with yet another aspect of the frame/brick construction of the present invention, the stave is curved with respect to one or both of a horizontal axis and a vertical axis.

In accordance with another aspect of the frame/brick construction of the present invention, each of the plurality of bricks comprises an oblique top section and an oblique bottom section, wherein each of the oblique top and bottom sections protrude from the face of the stave; the oblique top and bottom sections are substantially parallel and/or the plurality of bricks at least partially disposed in the plurality of channels form a plurality of stacked, substantially horizontal rows of bricks protruding from the front face of the stave; and/or the oblique top section of one brick is disposed substantially near, adjacent to, in partial contact with or in complete contact with the oblique bottom section of another brick immediately above the one brick.

In accordance with yet another aspect of the frame/brick construction of the present invention, the plurality of bricks comprise exposed faces that define a flat or uneven surface.

In another aspect, the present invention comprises a stave/brick construction, comprising: a plurality of staves standing side-by-side defining gaps between adjacent staves, wherein each stave has a plurality of ribs and a plurality of channels, wherein a front face of each stave defines a first opening into each of the channels, wherein each stave is curved with respect to one or both of a horizontal axis and a vertical axis; a plurality of bricks wherein each brick is insertable into one of the plurality of channels via its first opening to a position, upon rotation of the brick, partially disposed in the one channel such that one or more portions of the brick at least partially engage one or more surfaces of the one channel and/or of a first rib of the plurality of ribs whereby the brick is locked against removal from the one channel through its first opening via linear movement without first being rotated; wherein the plurality of bricks at least partially disposed in the plurality of channels form a plurality of stacked, substantially horizontal rows of bricks protruding from the front face of each stave and wherein the plurality of substantially horizontal rows of bricks disposed in the plurality of channels covers, in-whole or in-part, the gaps between adjacent staves; one or more wear monitors, wherein each wear monitor is disposed through or adjacent to the stave and/or one or more of the bricks and wherein each of the wear monitors my be read using a time-domain reflectometer and/or time-domain reflectometry; and one or more thermocouples disposed through or adjacent to the stave and/or one or more of the bricks.

In another aspect, the frame/brick construction of the present invention further comprises a laser emitter/receiver for taking readings by emitting one or more laser pulses onto the staves and/or plurality of bricks and for receiving the one or more laser pulses as reflected from the staves and/or plurality of bricks, and a computer for analyzing the reflected laser pulses to determine one or more conditions of the staves and/or plurality of bricks and/or differences in the one or more conditions of the staves and/or plurality of bricks between first and second readings.

Many other variations are possible with the present invention, and those and other teachings, variations, and advantages of the present invention will become apparent from the description and figures of the invention.

BRIEF DESCRIPTION OF THE SEVERAL VIEWS OF THE DRAWINGS

For the present disclosure to be easily understood and readily practiced, the present disclosure will now be described for purposes of illustration and not limitation in connection with the following figures, wherein.

DETAILED DESCRIPTION OF PREFERRED EMBODIMENT(S) OF THE INVENTION

In the following detailed description, reference is made to the accompanying examples and figures that form a part hereof, and in which is shown, by way of illustration, specific embodiments in which the inventive subject matter may be practiced. These embodiments are described in sufficient detail to enable those skilled in the art to practice them, and it is to be understood that other embodiments may be utilized and that structural or logical changes may be made without departing from the scope of the inventive subject matter. Such embodiments of the inventive subject matter may be referred to, individually and/or collectively, herein by the term "invention" merely for convenience and without intending to voluntarily limit the scope of this application to any single invention or inventive concept if more than one is in fact disclosed.

The following description is, therefore, not to be taken in a limited sense, and the scope of the inventive subject matter is defined by the appended claims and their equivalents.

Figure 1:
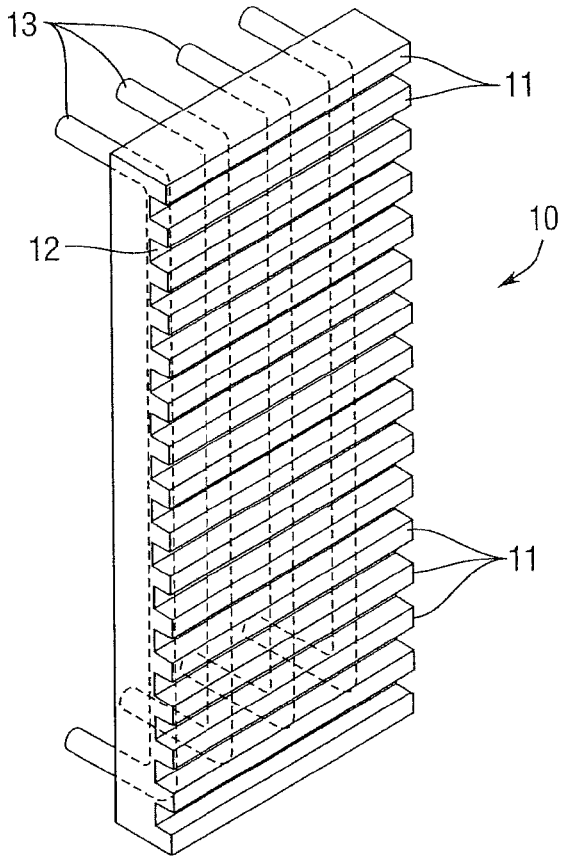
Prior Art Fig.1
FIG. 1 is a front perspective view of a conventional stave.

FIG. 1 illustrates a planar, fluid cooled stave 10 of known construction having a plurality of stave ribs 11 and defining a plurality of stave channels 12, both of generally rectangular cross-sections for use with bricks having matching cross-sections. Other stave designs of known construction (not shown) employ stave ribs and stave channels having cross-sections complementary to the dovetail sections 16 of the conventional refractory brick 14 shown in FIG. 2 to allow such dovetailed sections 16 thereof to be inserted into the side ends of the stave and slid into position therein with or without mortar in between each adjacent brick. A major disadvantage of such known stave/brick constructions is that due to the closeness to each other when installed in a furnace, such staves 10 must be removed from the furnace to allow the bricks 14 to be slid out of the stave channels 12 whenever the stave/brick construction needs to be rebuilt or repaired, either in-whole or in-part. Removing such staves 10 from the furnace is necessitated because bricks 14 cannot be removed or inserted into stave channels 12 through the front face of stave 10. As shown in FIG. 1, stave 10 comprises a plurality of pipes 13 disposed inside the stave 10 which may be connected to one or more external pipes that extend from the furnace shell side of the stave 10 and penetrate the metal shell of the furnace so that coolant, such as, for example, water at an elevated pressure is pumped through the pipes 13 in order to cool the stave 10 and any refractory bricks disposed within stave channels 12 when assembled and installed in a furnace.

Figure 2:
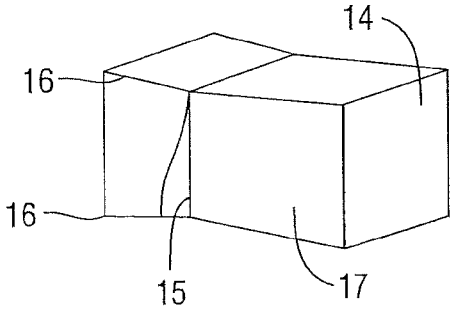
Prior Art Fig.2
FIG. 2 is a side perspective view of a conventional, dovetailed refractory brick.

As further illustrated in FIG. 2, conventional dovetailed refractory brick 14 has a relatively thin vertical neck 15 which is susceptible to breakage in the furnace environment, particularly where the length of protruding portion 17 of brick 14 which protrudes into the furnace from stave 10 is long relative to the overall depth or length of brick 14.

Figure 3:
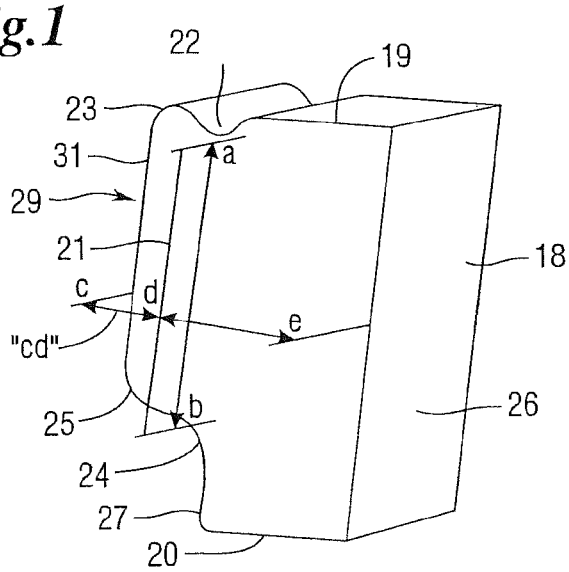
FIG. 3 is a side perspective view of a brick according to a preferred embodiment of the present invention.
Figure 4:
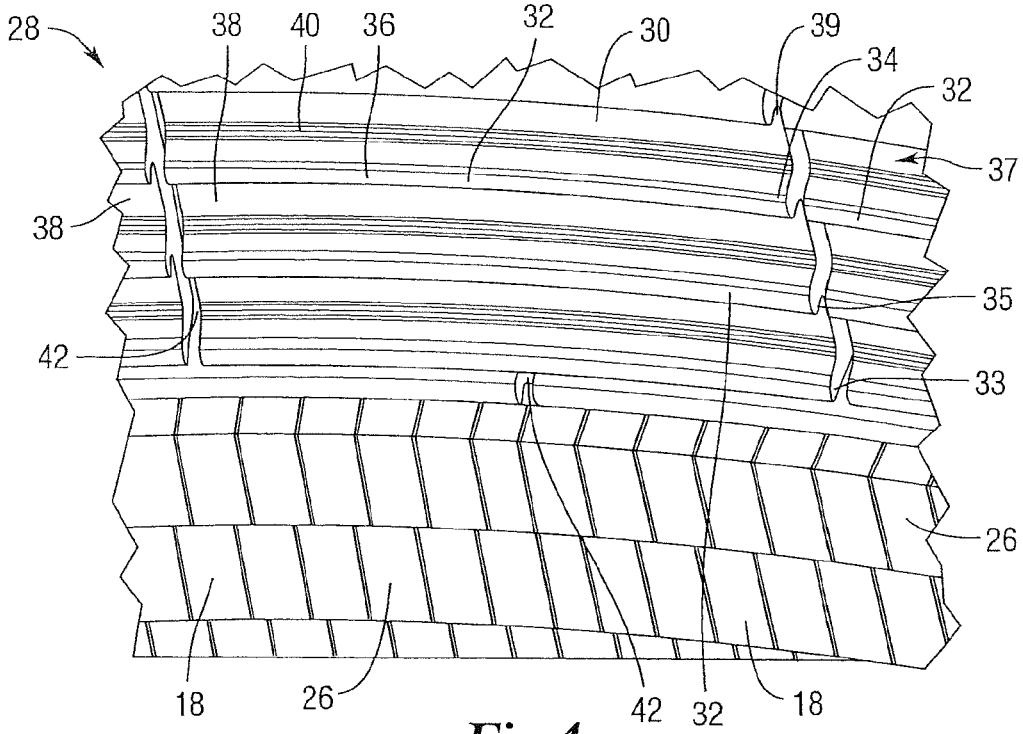
FIG. 4 is a top perspective view of a preferred embodiment of a furnace lining of the present invention comprising a preferred embodiment of a stave/brick construction of the present invention employing the brick of FIG. 3.

FIG. 3 illustrates a preferred embodiment of a refractory brick 18 according to a preferred embodiment of a stave/brick construction 28 of the present invention. Brick 18 has an exposed face 26 and oblique or slanted top and bottom sections 19 and 20, respectively. Brick 18 also comprises or defines a locking side 29 comprising concave groove 22, a generally arcuate nose 23, a generally arcuate seat 25, a generally arcuate concave section 24, a lower face 27 and a generally planar front face 31. Brick 18 also has a neck 21, the vertical thickness ("ab") of which is increased with respect to the vertical neck 15 of known bricks 14. Preferably, the length "ab" of vertical neck 21 is equal to or greater than about two (2) times the length "cd" of the depth of brick 18 that is disposed in stave channel 37 when the brick 18 is installed therein. The shapes, geometries and/or cross-sections of brick 18 and/or any part thereof, including, without limitation, one or more of exposed face 26, lower face 27, front face 31, oblique/slanted top section 19, oblique/slanted bottom section 20, groove 22, nose 23, seat 25, concave section 24 and front locking side 29 may be modified or take other forms such as being angular, rectilinear, polygonal, geared, toothed, symmetrical, asymmetrical or irregular instead the shapes of the preferred embodiments thereof as shown in the drawings hereof without departing from the scope of the invention hereof. The refractory bricks 18 of the present invention preferably may be constructed from many of the refractory materials currently available including, but not limited to, silicon carbide (such as Sicanit AL3 available from Saint-Gobain Ceramics), MgO—C (magnesia carbon), alumina, insulating fire brick (IFB), graphite refractory brick and carbon. In addition, bricks 18 may be constructed from alternating or different materials depending upon their location in a stave 30 or within the furnace. Also, as set forth above, the shape of bricks 18 may also be modified or altered to meet various stave and/or furnace spaces and/or geometries.

Preferred embodiments of a stave/refractory brick construction 28 of the present invention is shown in FIGS. 3-8 and 10, including a preferred embodiment of a stave 30 of the present invention. Stave 30 may comprise a plurality of pipes (not shown), such as the pipes 13 disposed inside the stave 10 as shown in FIG. 1, which may be attached to one or more external pipes that extend from the furnace shell side of the stave 30 and penetrate the metal shell of the furnace so that coolant, such as, for example, water at an elevated pressure is pumped through such pipes (not shown) in order to cool the stave 30 and any refractory bricks 18 disposed within stave channels 37 thereof when assembled and installed in a furnace. Preferably, the stave 30 is constructed of copper, cast iron or other metal of high thermal conductivity, while any pipes disposed within stave 30 are preferably made from steel or copper or copper alloys such as a UNS C71500 copper-nickel alloy or a Monel-400 copper-nickel alloy (Monel-400 is a trademark brand for an alloy of about 63% nickel and 31% copper).

Each stave 30 preferably may be curved about its horizontal axis and/or about its vertical axis to match the internal profile of the furnace or area in which they will be used. Each stave 30 preferably comprises a plurality of stave ribs 32 and a stave socle 33 to support stave 30 in a standing position which may be a fully upright 90 degrees as shown, or a tilted or slanted position (not shown). Each stave rib 32 preferably defines a generally arcuate top rib section 34 and a generally arcuate bottom rib section 35. Stave 30 preferably defines a plurality stave channels 37 between each successive pair of stave ribs 32. Preferably, each stave channel 37 is generally "C-shaped" or "U-shaped" and includes a generally planar stave channel wall 38, although stave channel wall 38 may also be curved or contoured along its vertical and/or horizontal axes, toothed, etc., to be complementary with the front face 31 of brick 18 if such front face 31 has a shape other than the planar shape depicted herein, which may depend upon the application. Each stave channel 37 also preferably includes a generally arcuate upper channel section 39 and a generally arcuate lower channel section 40, all as defined by stave 30 and a successive pair of stave ribs 32. The shapes, geometries and/or cross-sections of one or more of the stave ribs 32, top rib sections 34, bottom rib sections 35, stave channels 37, stave channel walls 38, upper channel sections 39 and lower channel sections 40, preferably may be modified or take other forms such as being contoured, angular, rectilinear, polygonal, geared, toothed, symmetrical, asymmetrical or irregular instead the shapes of the preferred embodiments thereof as shown in the drawings hereof without departing from the scope of the invention hereof.

Figure 5:
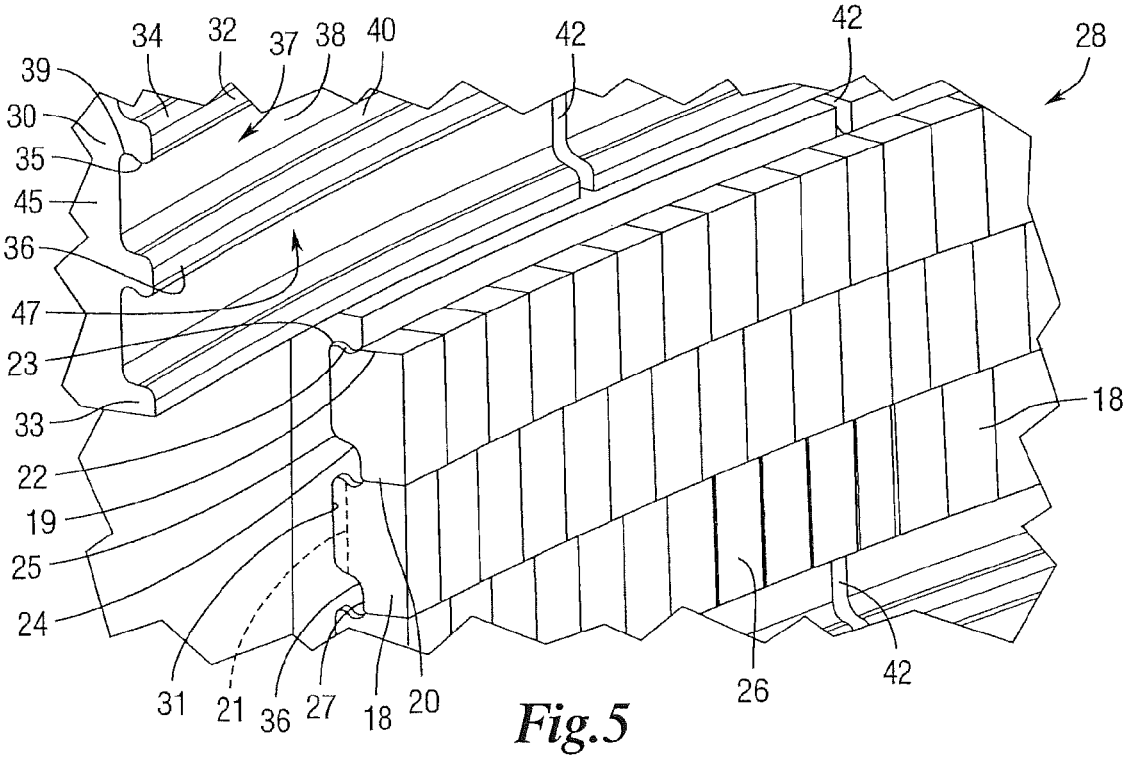
FIG. 5 is a side perspective view of a preferred embodiment of a furnace lining of the present invention comprising a preferred embodiment of a stave/brick construction of the present invention employing the brick of FIG. 3.
Figure 6:
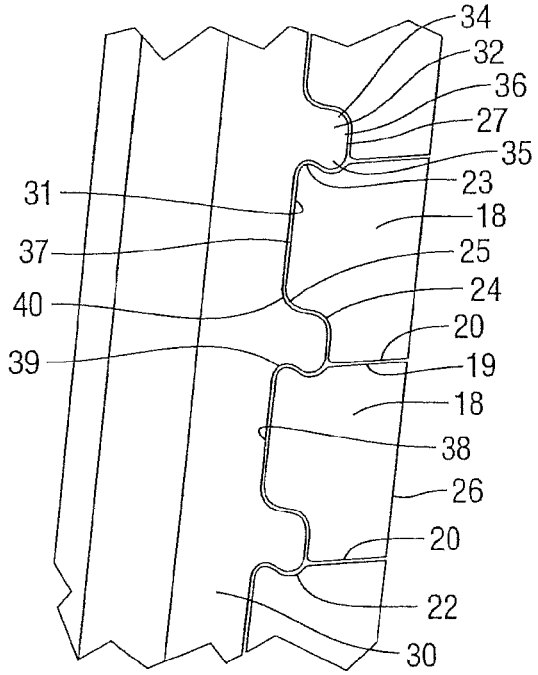
FIG. 6 is a cross-sectional view of a preferred embodiment of a stave/brick construction of the present invention employing the brick of FIG. 3.
Figure 7:
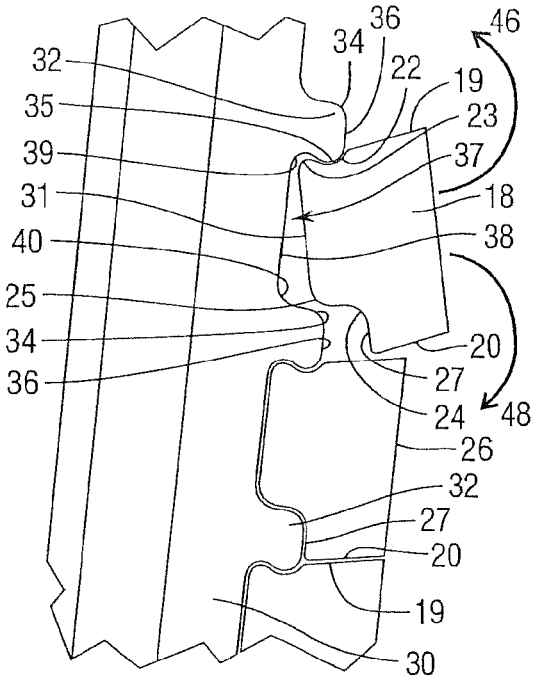
FIG. 7 is a cross-sectional view of a preferred embodiment of a stave/brick construction of the present invention showing the brick of FIG. 3 as it is being inserted or removed from a front face of a preferred embodiment of a stave of the present invention.

As shown in FIGS. 6 and 7, while the stave bricks 18 of the present invention may be slid into stave channels 37 from the sides 45 of stave 30 when space permits, stave bricks 18 may also preferably and advantageously be inserted into the front face 47 of staves 30. Beginning at the bottom of stave 30, each stave channel 37 may be filled with stave bricks 18 by rotating or tilting each brick 18 in a first direction 46 where the bottom portion of brick 18 moves away from stave 30 preferably (1) about an axis substantially parallel a plane of the stave or (2) to allow nose 23 to be inserted into stave channel 37 and into concave, arcuate upper channel section 39, after which brick 18 is rotated in a second direction 48 generally such that the bottom of brick 18 moves toward stave 30 until (i) nose 23 is disposed in-whole or in-part within concave, arcuate upper channel section 39 with or without the perimeter of nose 23 being in partial or complete contact with upper channel section 39, (ii) front face 31 of brick 18 is disposed substantially near and/or adjacent to channel wall 38 with or without the front face 31 being in partial or complete contact with channel wall 38, (iii) arcuate seat 25 is disposed in-whole or in-part within arcuate lower channel section 40 with or without the perimeter of seat 25 being in partial or complete contact with lower channel section 40, (iv) arcuate concave section 24 is disposed in-whole or in-part over the arcuate top rib section 34 of the lower stave rib 32 of the successive pair of stave ribs 32 defining the stave channel 37 into which the brick 18 is being inserted with or without the inside surface of concave section 24 being in partial or complete contact with the arcuate top rib section 34 of such lower stave rib 32, (v) lower face 27 of brick 18 is disposed substantially near and/or adjacent to rib face 36 with or without the lower face 27 being in partial or complete contact with rib face 36, and/or (vi) slanted bottom section 20 of the brick 18 being installed is disposed substantially near and/or adjacent to slanted top section 19 of the brick 18 immediately below the brick 18 being installed with or without such slanted bottom section 20 being in partial or complete contact with such slanted top section 19, in the case where the brick 18 is being installed in any of the stave channels 37 except the lowest stave channel 37 of stave 30. As illustrated in FIGS. 5-7, when the nose 23 is disposed in-whole or in-part within concave, arcuate upper channel section 39 with or without the perimeter of nose 23 being in partial or complete contact with concave, upper channel section 39, and/or arcuate seat 25 is disposed in-whole or in-part within concave, arcuate lower channel section 40 with or without the perimeter of seat 25 being in partial or complete contact with concave, lower channel section 40, each of the bricks 18 is prevented from being moved linearly out of stave channel 37 through the opening in the front face 47 of stave 30 without each brick 18 being rotated such that the bottom thereof is rotated away from the front face 47 of stave 30.

As also shown in FIGS. 5-8, once a row of bricks 18 is installed in a stave channel 37 above a row of previously installed bricks 18, the bricks 18 in such immediately lower row are locked into place and cannot be rotated in the first direction 46 away from stave 30 to be removed from stave channel 37. The stave/refractory brick construction 28 of the present invention as shown in FIGS. 3-7 and 10 may be employed with or without mortar between adjacent stave bricks 18.

Figure 8:
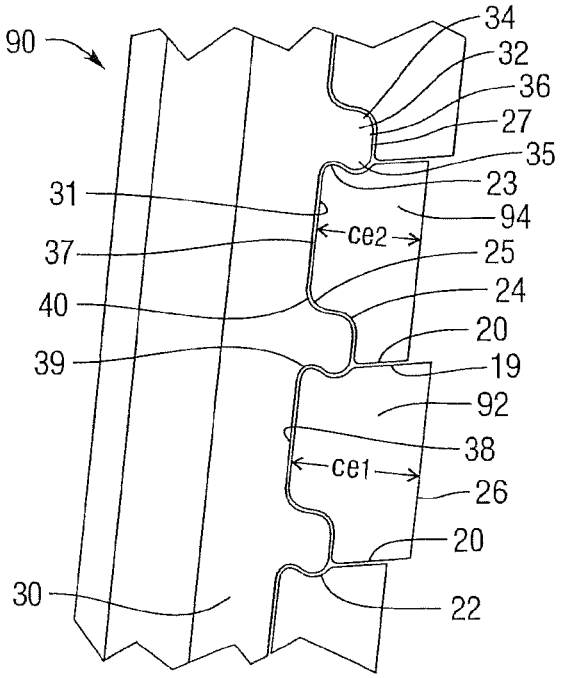
FIG. 8 is a cross-sectional view of a preferred embodiment of an alternative stave/brick construction of the present invention employing at least two different sizes of the bricks of FIG. 3.

FIG. 8 illustrates another preferred embodiment of a stave/brick construction 90 of the present invention which is the same as stave/brick construction 28 of FIGS. 4-7 except that it employs at least two different sizes of stave bricks 92 and 94, respectively, to form an uneven front face 96. As shown, bricks 92 of the stave/brick construction 90 have a greater overall depth "ce1" than the depth "ce2" of bricks 94. This staggered construction resulting from the different depths of stave bricks 92 and 94, respectively, may preferably be used in accretion zones or other desirable zones of the furnace where the uneven front face 96 would be more effective at holding an accretion or buildup of material to further protect the bricks 92 and 94 from thermal and/or mechanical damage.

Figure 9:
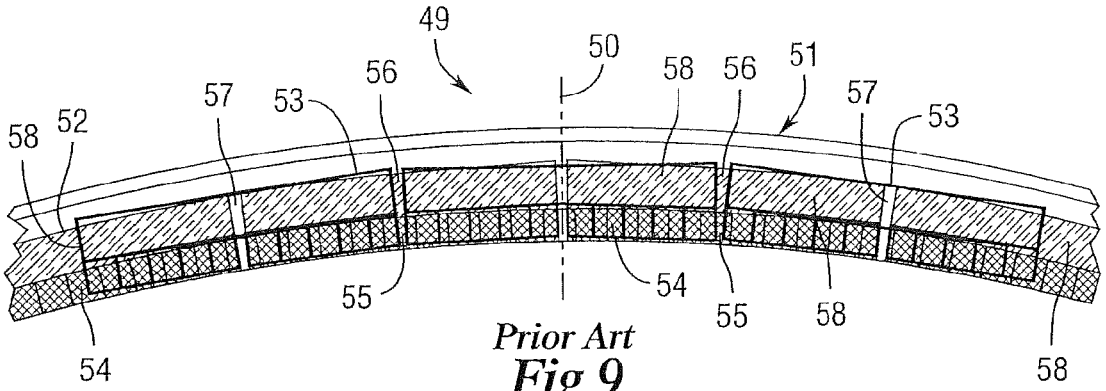
Prior Art Fig.9
FIG. 9 is a top plan view of a conventional furnace lining employing conventional stave/brick constructions.
Figure 10:
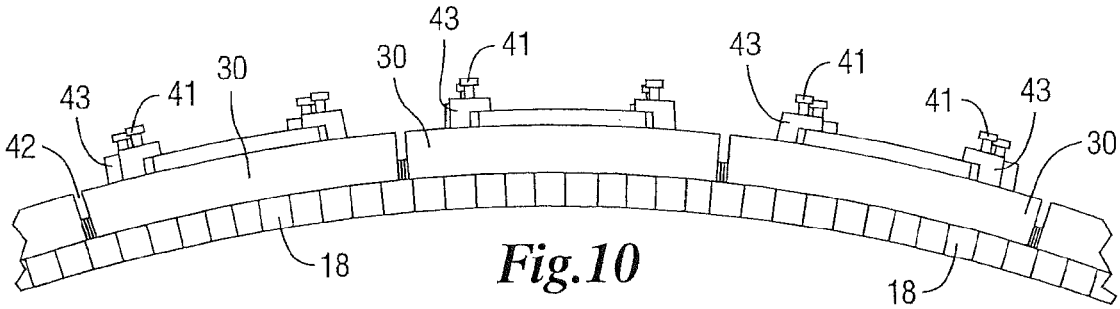
FIG. 10 is a top plan view of a preferred embodiment of a furnace lining of the present invention comprising a preferred embodiment of a stave/brick construction of the present invention employing the brick of FIG. 3.

FIG. 9 illustrates the use of conventional stave/brick constructions 58 within a furnace 49. When using flat or curved staves/coolers, such as the flat/planar upper and lower staves 52 and 53, respectively, with pre-installed bricks 54 arranged within furnace shell 51, such staves 52 and 53 are installed in the furnace 49 such that ram gaps 56 exist in between adjacent pairs of upper staves 52 and such that ram gaps 57 exist in between adjacent pairs of lower staves 53, both to allow for construction allowance. These ram gaps 56 and 57 must be used to allow for construction deviation. Such ram gaps 56 and 57 are typically rammed with refractory material (not shown) to close such gaps 56 and 57 between the adjacent stave/brick constructions 58. Such material filled gaps 56 and 57 typically are weak points in such conventional furnace linings using stave/brick constructions 58. During operation of furnace 49, the rammed gaps 56 and 57 erode prematurely and furnace gases track between the stave/brick constructions 58. With the preferably curved stave/brick constructions 28 of the present invention, the furnace can be bricked continuously around its circumference to eliminate conventional rammed gaps with bricks 18. As shown in FIG. 10, the gaps 42 between staves 30 are covered by one or more of bricks 18 of the present invention, eliminating the need for ramming filling material into such gaps 42. By eliminating the conventional rammed gaps 56 and 57 between the furnace bricks of adjacent staves 30, the integrity and life of the furnace and/or furnace lining is increased.

Another problem associated with the conventional stave/brick constructions 58 having pre-installed bricks 54, as shown in FIG. 9, is that because such conventional stave/brick constructions 58 are not continuously bricked around the circumference of furnace 49, edges 55 of numerous of the bricks 54 protrude into the interior of furnace 49 and are thus exposed to any matter falling through the furnace 49. Such protruding edges 55 tend to wear faster and/or are susceptible to being hit by falling matter, causing such bricks 54 with protruding edges 55 to break off into the furnace 49 and expose the staves 52 and 53. Again, the stave/brick constructions 28 of the present invention allow the furnace to be bricked continuously around its circumference thereby eliminating any such protruding brick edges 55, as shown in FIG. 10. Thus, the occurrences of (i) bricks 18 being pulled or knocked out of staves 30 and (ii) of staves 30 being directly exposed to the intense heat of the furnace are both significantly reduced by the stave/brick construction 28 of the present invention. Such characteristics make the stave/brick construction 28 of the present invention well-suited for use in the stack of blast furnaces.

As also shown in FIG. 10, a plurality of pin mounting cylinders 43 are preferably formed on the back side of each stave 30 for mounting pins 41 used to handle each stave 30, and/or to secure and/or mount each stave 30 within a furnace. Each of the pins 41 preferably defines a threaded or unthreaded thermocouple mounting hole (not shown) allowing one or more thermocouples to be easily installed at various locations on each stave 30.

While the preferred embodiment of a stave/refractory brick construction 28 of the present invention shown in FIGS. 3-8 and 10, includes a preferred embodiment of a furnace cooler or stave 30, the teachings of the present invention are also applicable to a frame/brick construction where such frame (not shown) is not limited to a furnace cooler or stave 30, but is a frame for providing a standing or other supported vertical or slanted wall of bricks, whether or not refractory bricks, for applications including, but not limited to, furnace applications.

Figure 11:
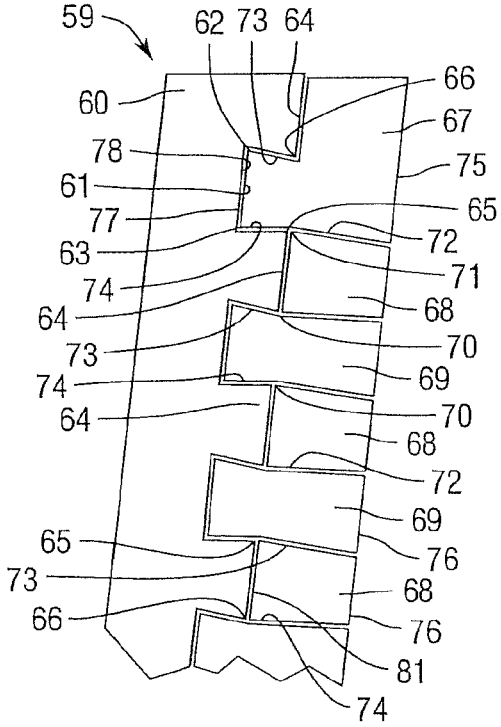
FIG. 11 is a cross-sectional view of another preferred embodiment of a stave/brick construction of the present invention.
Figure 12:
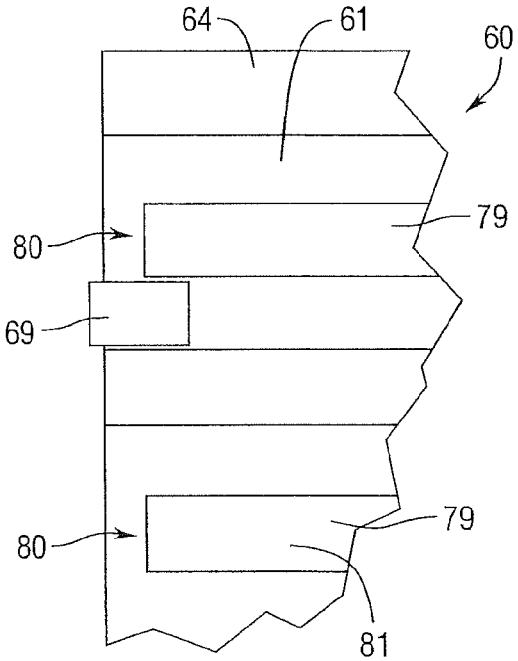
FIG. 12 is a partial, front elevational view of the stave/brick construction of FIG. 11.

FIGS. 11-12 illustrate another preferred embodiment of a stave/brick construction 59 of the present invention comprising stave 60 and alternating shallow and deep dovetail bricks 68 and 69, respectively, including top line stave brick 67 which preferably has the same depth as a long brick 69 and an exposed face 75 of greater height than the exposed faces 76 of the other shallow and deep dovetail bricks 68 and 69. As shown, both shallow and deep dovetail bricks 68 and 69 have upper and lower dovetail or oblique sections 73 and 74, respectively. Further, each of the bricks 67, 68 and 69 defines two brick corners 71 while deep bricks 69 define two concave brick vertexes 70 that match up with the brick corners 71 of shallow bricks 68 upon completion of the stave/brick construction 59 of the present invention. Stave 60 preferably comprises a plurality of stave ribs 64 and a stave socle (not shown) to support stave 60 in a standing position which may be a fully upright 90 degrees, or a tilted or slanted position. Each stave rib 64 preferably defines generally angular upper and lower rib edges 65 and 66, respectively. Stave 60 preferably defines a plurality stave channels 61 between each successive pair of stave ribs 64. Preferably, each stave channel 61 comprises a generally planar stave channel wall 77, although stave channel wall 77 may also be curved or contoured along its vertical and/or horizontal axes, toothed, etc., to be complementary with the front faces 78 of the deep dovetail bricks 69 if such front face 78 has a shape other than the planar shape depicted herein, which may depend upon the application. Each stave channel 61 also preferably includes a generally dovetail-shaped upper channel section 62 and a generally dovetail-shaped lower channel section 63, all as defined by stave 60 and a successive pair of stave ribs 64. The shapes, geometries and/or cross-sections of one or more of the stave ribs 64, upper and lower rib edges 65 and 66, stave channels 61, stave channel walls 77, upper channel sections 62, lower channel sections 63, brick vertexes 70 and brick edges 71, upper and lower dovetail sections 73 and 74, exposed faces 75 and 76 and front faces 78 preferably may be modified or take other forms such as being contoured, angular, rectilinear, polygonal, geared, toothed, symmetrical, asymmetrical or irregular instead the shapes of the preferred embodiments thereof as shown in the drawings hereof with out departing from the scope of the present invention.

The view of stave/brick construction 59 of the present invention in FIG. 12 shows that every other one 79 of stave ribs 64 is preferably shortened by less than half the thickness (i.e., width) of bricks 67, 68 and 69, that is by: ((brick thickness—designed gap length between the staves or coolers)/2)+ ¼" for construction deviation. An additional brick (not shown), preferably of higher thermal conductivity to promote cooling similar to that of the stave/cooler 60, would be installed in place of the missing section of stave rib 64 to fill the void 80. Such stave/brick construction 59 allows the bricks 67, 68 and 69 to be inserted into and/or removed from stave channels 61, after stave 60 has been installed in the furnace, by sliding such bricks into stave channels 61 via voids 80, i.e., the extra room created by shortened stave ribs 79.

The stave/brick construction 59 may preferably employ a single brick design (not shown) or the alternating shallow and deep bricks 68 and 69, respectively, as shown in FIG. 11 wherein the dovetail sections 73 and 74 of deep bricks 69 are inserted and received into stave channels 61, each of the front faces 78 of shallow bricks 68 is disposed substantially near and/or adjacent to a respective face 81 of a stave rib 64 with or without such front face 78 being in partial or complete contact with its respective rib face 81, and each of the brick edges 71 of shallow bricks 68 is disposed substantially near and/or adjacent to a respective vertex 70 of a deep brick 69 with or without such brick edge 71 being in partial or complete contact with its respective vertex 70 of a deep brick 69. Additionally, other stave/brick constructions employing bricks of two or more different shapes with a portion of all such bricks being received in a stave channel is within the scope of the present invention.

The stave/brick constructions of the present invention preferably also may be assembled initially by setting the bricks in a for un and casting the stave around the bricks.

Figure 13:
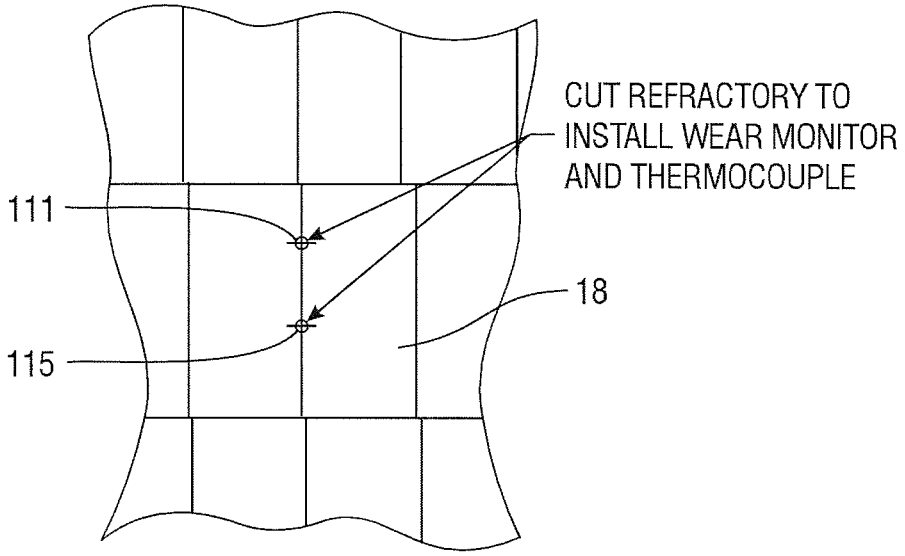
FIG. 13 is a furnace interior-side view of refractory wall with holes for receiving a preferred wear monitor and/or thermocouple according to the present invention.

The refractory wear monitoring system 100 of the present invention (FIGS. 13-15, 18 and 19) increases the accuracy of measurement of refractory and stave thickness and wear and provides an early warning system for refractory wear. The refractory wear monitoring system 100 of the present invention is preferably employed with conventional stave/brick systems, drilled and plugged stave/brick systems and/or the improved double-locking stave/brick systems disclosed herein. FIG. 13 depicts the placement of the wear monitor system 100 of the present invention in a stave/brick construction 28 at a critical wear region where there is a desire to monitor/determine the refractory wall thickness and condition. Holes are cut into the refractory at 111 and 115 between refractory bricks 18 to allow the insertion of the wear monitors 101 and thermocouples 105 into the cut refractory wall. Installing a combination of wear monitors 101 and thermocouples 105 into the stave/brick construction 28 allows for the continuous monitoring of process information such as refractory depth and temperature to optimize furnace and refractory performance, establish stable accretions and maximize furnace life. Using the wear monitoring system and improved stave/brick construction 28 of the present invention, it is possible to identify if and where refractory is wearing out and replace it during a short furnace outage without removing the staves 30.

Figure 14:
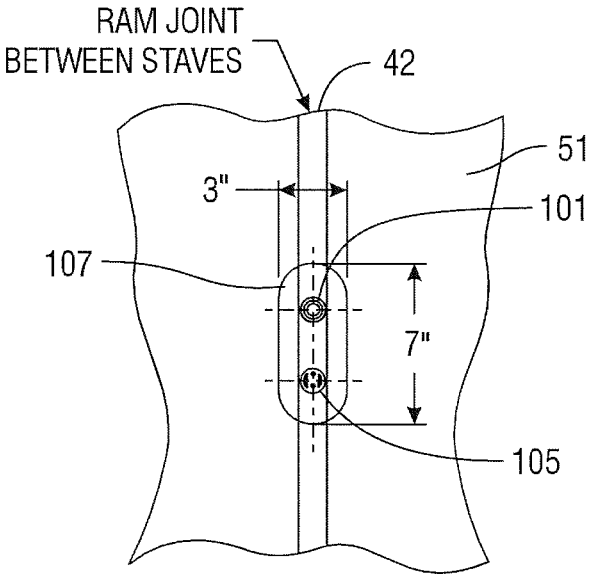
FIG. 14 is partial plan view showing a preferred wear monitor and thermocouple of the present invention installed in a ram joint between two staves.
Figure 15:
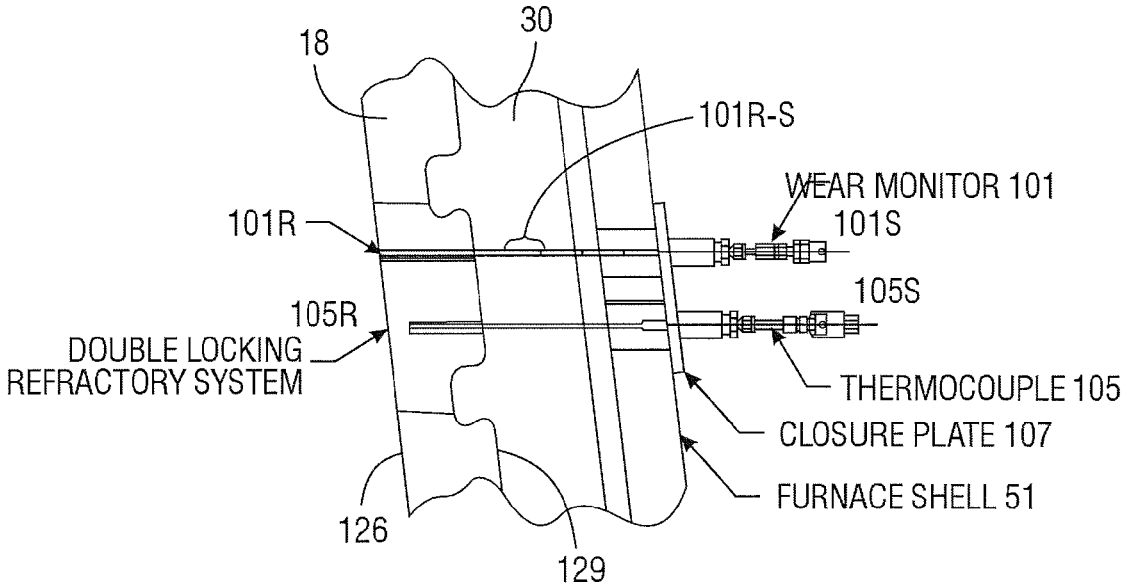
FIG. 15 is a cross sectional view of a stave/brick construction incorporating a preferred wear and temperature monitoring system of the present invention.

FIG. 14 depicts the placement of the refractory wear monitors 101 and the thermocouples 105 in the ram gap joint 42 disposed between staves 30 where the holes for placing the wear monitor 101 and the thermocouple 105 have been fashioned. The holes may be made by drilling or defined by the refractory material used to fill ram gaps 42. Once the wear monitor 101 and the thermocouple 105 have been placed into their respective holes, the cement of a similar type to that of the bricks 18 may be used to fill in the spaces and secure the placement of the wear monitor 101 and the thermocouple 105.

FIG. 5 is a side perspective view of a preferred embodiment of a stave/brick construction 28 for use with the wear monitoring system 100 of the present invention as shown in FIGS. 13-16. The refractory wear monitoring system 100 of the present invention is directed to a preferred apparatus for measuring the thickness of refractory wall in a blast furnace or other type of metallurgical apparatus and, more specifically, to measuring the thickness of a refractory wall of a stave/brick construction 28.

The preferred wear monitors 101 are designed to used with time-domain reflectometry techniques and have two ends, a refractory end 101R and a system end 101S. The system end 101S may be operatively connected to a junction box or may be connected directly to the electrical connector means by which the device is connected to an electronic monitor instrument. As there are regions of the furnace that experience greater wear than other regions, these specific known critical wear regions or the critical wear zones are the likely points were refractory wear will predominantly take place. As the refractory in the furnace erodes, the refractory ends 101S of the wear monitors 101 the monitoring system 100 also erode at substantially the same rate as the refractory and/or refractory bricks 18. The loss in length of the monitoring device 101 is substantially equal to the loss of the refractory because the original thickness of the refractory and the position of the refractory ends 101S of the wear monitors 101 can be determined at any time from the length of the monitoring device displayed on the analysis equipment used in association with the present invention. This calculation is accomplished by subtracting the displayed length of the monitoring device 101 from the original displayed length thereof, determined along with a suitable calibration of the recording instrument and in turn subtracting the difference determined from the known thickness of the original refractory. Alternately stated, the erosion or loss in thickness of the refractory is equal to the loss of length of the embedded wear monitor 101. The included thermocouple devices 105 may also be used to monitor the temperature at such measured locations on an ongoing basis.

A third preferred aspect of the present invention is using a laser or optical scanner to produce a profile of the furnace refractory interior surface for determination of any significant changes that indicate refractory loss that can take place within critical and/or non-critical wear regions of the furnace. The laser or optical detector/scanner 120 of the present invention preferably comprises a laser light emitter and a receiver to scan the interior where the profile measurements are detected through triangulation methods.

It is generally known within the industry the critical wear regions comprising lower stack and bottom locations in blast furnaces experience predictably greater wear due to constant contact with the molten metal and the chemical reactions of the smelting iron oxide purifying reaction process. There are also known regions of other furnace types that experience inordinately greater wear than the vast majority of the furnace interior. At designated locations in the this high wear region the bricks 18 may be pre-formed with receptacles for the wear monitors 101 and thermocouples 105 or the wear monitors 101 and thermocouples 105 may be installed after the bricks 18 have been installed.

Figure 16:
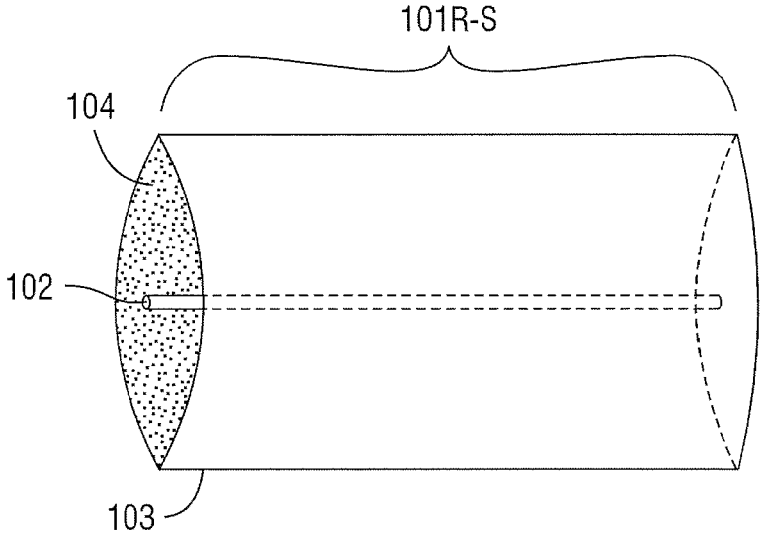
FIG. 16 is a sectional plan view and close up of section 101R-S of FIG. 15.

As shown in FIG. 16, the refractory wear monitoring system 100 of the present invention preferably comprises wear monitors 101 comprising a central metallic conductor 102 and an outer metallic sheath 103 separated from the conductor by a fine close-packed insulating 104 material having a desirable dielectric constant. The wear monitors 101 each having two ends, a refractory end 101R and a system end 101S. The refractory brick 18 has a furnace side 126 and a stave side 129. The refractory end 101R of the wear monitor traverses the refractory to furnace side surface 126 coming even with the surface and the wear monitor portion. The wear monitor system end 101S may be lead to a junction box and be connected to an electrical connector means attached thereto or may be connected directly to the electrical connector means by which the device is connected to an electronic instrument which uses time-domain reflectometry The conductor and sheath are made from any material which will be electrically conductive and withstand the hostile environment of the interior of a furnace or other metallurgical apparatus. Appropriate materials for the conductor 102 include stainless steel, molybdenum, iron, platinum, tungsten, and nickel-base alloys. A preferred construction is to use molybdenum for the conductor 102 and stainless steel for the sheath 103.

Again referring to FIG. 15, the system end 101S of the wear monitor 101 is designed to pass through staves 30 as shown in FIG. 10 wherein each of the monitoring pins 41 may preferably define a threaded or unthreaded hole or conduit for receiving a wear monitor 101 and/or thermocouple 105 according to the present invention. The wear monitor refractory ends 101R pass through the staves 30, bricks 18 and on through the shell of the furnace. Each thermocouple 105 will also have a refractory end 105R and a system end 105S. The thermocouples 105 will not traverse the refractory bricks 18 as the wear probes 101R do, but will stop at a point determined to be an imminent fail location. When the bricks 18 wear to the point of the imminent fail location, the thermocouples 105 will begin to wear. At that point, there can be a fail-safe system warning of imminent failure at that location. Both system ends of the wear monitors 101S and the thermocouple 105S will extend past the staves 30 and traverse the furnace shell. A closure plate 107 is set around the ends 105S of thermocouple 105 and 101S of wear monitor 101 that project through the furnace shell 51. The thermocouples 105 preferably may be of type B, S, R or K or similar capable type that may be hereinafter invented for recording high temperatures with reasonable accuracy and reliability. The closure plate 107 can be made of any suitable material having the appropriate temperature resistant and wear qualities for sealing or supporting the furnace vessel shell. It is also foreseeable to have a refractory bricks having integrated wear monitors and/or thermocouples that would be placed along critical wear regions in an alternating position at specific distances to further extend the coverage area of the wear monitor system 100.

Data transmitting cables are then attached to the thermocouple 105S and the wear monitor 101S system ends. These data transmitting cables may lead to the electronic data relay circuit junction boxes. These junction boxes are assigned according to the probe and thermocouple location. This enables signals to be transmitted and data to be read by computer processing equipment according to the location of the specific probes. The data readings may be made during work outages or data can be continuously transmitted "real time" during furnace operation. The signals may be transmitted directly to a local testing analysis computer or may be transmitted via network connections to an off-site location or the data feed could be transmitted to both a local analysis computer and via network to an off-site location for reading and analysis. This data provided from the thermocouple and wear monitor is processed by computers for temperature status and remaining wall thickness and analyzed by operators and engineers to determine the immediate effect of the practices to the staves 30 and refractory bricks 18. This analysis can be done both on-site and/or remotely as the data can be transmitted through network connections, therefore off-site engineers can interact with the on-site engineers to determine best operating temperatures/conditions for the furnace. The engineers and operators can then adjust furnace variables to provide optimum furnace performance and ascertain the available time remaining before necessary furnace shutdown to facilitate refractory replacement and thereby improve efficiency while preventing catastrophic failure and/or furnace blowout.

Figure 17:
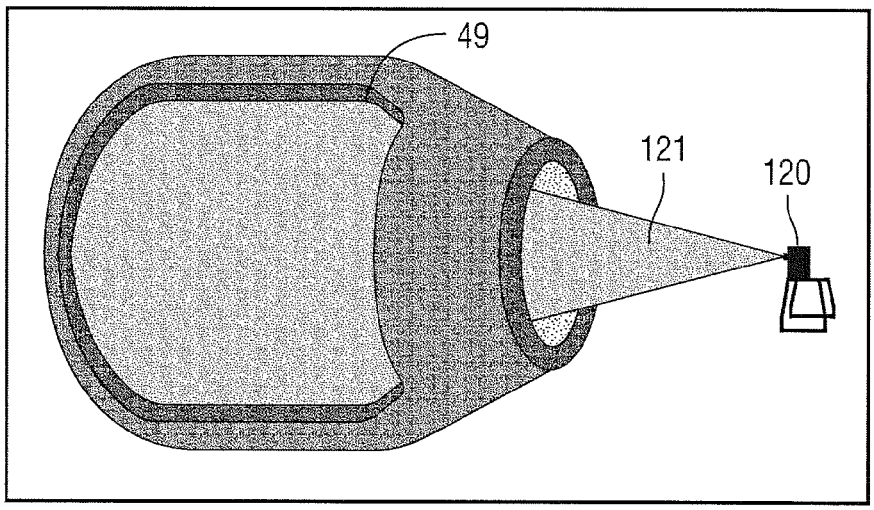
FIG. 17 is a side plan view representation of a laser emitter/receiver used in conjunction with and part of a preferred wear and temperature monitoring system of the present invention.
Figure 18:
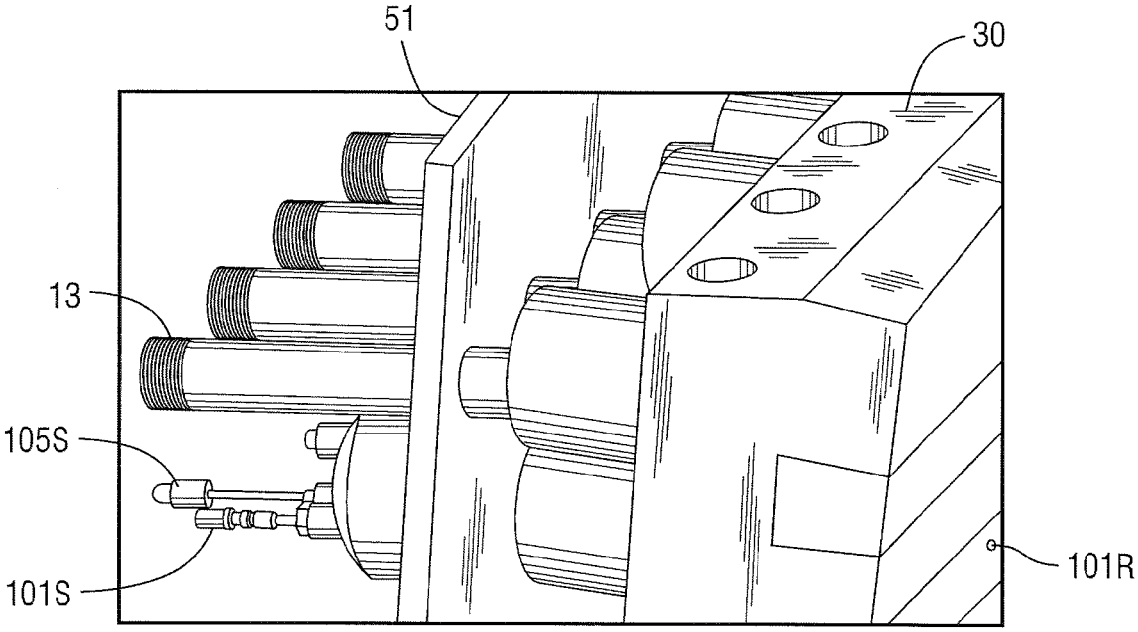
FIG. 18 is a side view representation of the refractory wall and stave construction of the present invention with thermocouple and wear monitor installed in an alternate embodiment of the present invention.
Figure 19:
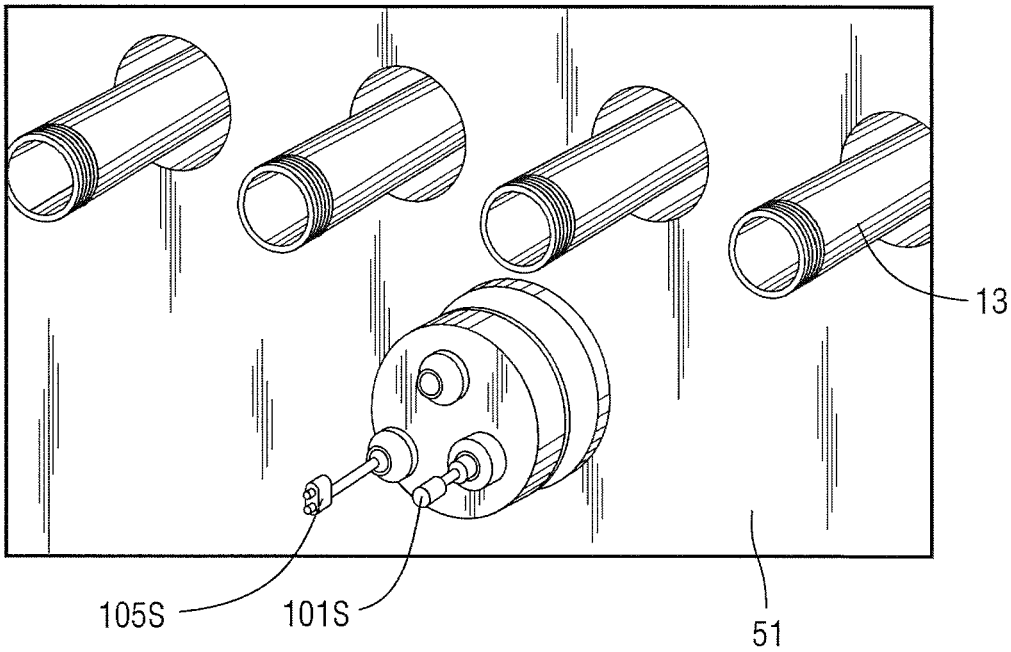
FIG. 19 is a furnace wall view of the refractory wear monitor and thermocouple installed in an alternate embodiment of the present invention.

FIG. 17 shows a further preferred embodiment of the present invention which integrates a laser scanning and mapping system 117 to automatically scan and map the interior of the furnace and track the internal condition of staves 30 and refractory bricks 18. The mapping system 117 uses energy waves such as laser light waves 121 from a emitter/receiver unit 120 to obtain the distance between the refractory wall and the wave generator based on the time duration or the phase difference of waves from the emission by the emitter/receiver 120 till the return of the light waves 121 to the emitter/receiver 120 after being reflected by the faces of refractory wall and/or bricks 18, and based on changes of this distance, calculates the position and the amount of corrosion and the thickness of the refractory wall and/or bricks 18. This scan may take place between load periods and/or at maintenance times. In a preferred embodiment of the laser mapping system 117, an original time point T0 reference mapping scan is taken to serve as a baseline to determine changes over time to the refractory surface. A point T0 reference time refractory layer mapping analysis would preferably be taken for later comparison at later scan times and held in the database memory. The scans performed at later points will be cross referenced to analyze changes in the surface structure as a direct comparison. The point T0 mapping scans are not required to be taken during a maintenance shutdown of the furnace, but for optimal comparison to later point mapping scans, a full inspection and measurement analysis could preferably be taken to determine refractory thickness and condition. This may be done at the time of the installation of the refractory bricks 18 and staves 30. Additional preferred embodiments of the laser mapping scan system 100 will map the interior of the furnace without the necessity of taking a baseline T0 comparative reading at the refractory installation point.

The system of the present invention preferably takes into account various data factors provided including vessel tilt, accretion density, slag weight, charge weight and scans the interior generating a map providing a quantitative and qualitative assessment of vessel lining thickness. The emitter/receiver 120 is connected to a computer and the data from the laser scan will be processed by a computer. The emitter/receiver 120 can be directly attached to the computer by way of data transmitting cables or the laser scanning device may be attached to wireless transmitter or have a self contained wireless transmitter and relay the data to the computer database by way of wireless interface with the computer. The data transmitted to the database may be integrated in a single display with the data from the refractory wear monitors 101 and the thermocouples 105 creating a whole system map with a three dimensional visual presentation. Alternatively, the data may be displayed independently in various formats and display views as needed for detailed and/or customized analysis.

The emitter/receiver 120 can be provided either on a fixed platform at an area having access to the interior of the furnace or as a mobile platform. For fixed location applications, the laser system 117 may be mounted in a cooled protective enclosure. The door can be actuated to expose the scanning laser optics. The cooled enclosure may be cooled with any coolant appropriate for the function and capable of protecting the laser optic emitter/receiver 120, including water. The door can be actuated with any known means that would be appropriate for high temperature conditions, including pneumatic or hydraulic actuation means. During operation, the laser emitter/receiver 120 will broadcast energy waves into the furnace and read the reflected waves. The frequency is not refracted by the heat energy and while some dispersion may be caused by matter within the furnace, the scanning frequency and software algorithms compensate for any deflection that may result in stray data points and the resulting data can be displayed as a map indicting the distances of the various interior surfaces of the refractory walls and/or bricks 18 that can be calculated by the software to determine refractory thickness.

Additionally, a further embodiment of the laser optic scanner can be introduced into the interior 49 of the furnace via a lance tip. Wherein the laser optic scanner is provided within the shielded protected receptacle on a lance tip, the lance is cooled with any coolant appropriate, including water and projected into the furnace to scan the interior surfaces of the refractory and/or bricks 18. It is also foreseen that a further embodiment of the laser optic scanner provides that the laser optic scanner can function as a mobile unit and be set in at any opening to the furnace that may provide ease of scan. A high speed 3-D scanner coupled with laser-based localization system integrates a localization identification system that identifies specific points to work for position identification. At present, a feature of the laser scan system 100 and the algorithm used for measurement analysis where the scanner scans over 8,000 points per second for over one million individual contour measurements, it is perceived that future computational advances will increase the analytical mapping capabilities of the laser mapping system 100. The scan data can then be broadcast with via wired or wireless networks to a computer that will generate a map profile of the vessel. Such profile can be used in combination with the present invention's system of thermocouples 65 and wear monitors 61 to analyze wear points in the furnace to detect loss of refractory inside or outside of critical wear regions of the furnace to an accuracy of about 6 mm.

In the foregoing Detailed Description, various features are grouped together in a single embodiment to streamline the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A stave/brick construction, comprising:

a stave having a plurality of ribs and a plurality of channels, wherein a front face of the stave defines a first opening into each of the channels;

a plurality of bricks wherein each brick is insertable into one of the plurality of channels via its first opening to a position, upon rotation of the brick, partially disposed in the one channel such that one or more portions of the brick at least partially engage one or more surfaces of the one channel and/or of a first rib of the plurality of ribs whereby the brick is locked against removal from the one channel through its first opening via linear movement without first being rotated; and one or more wear monitors, wherein each wear monitor is disposed through or adjacent to the stave and/or one or more of the bricks.

2. The stave/brick construction of claim 1 wherein each of the wear monitors comprises a metallic conductor coax and an outer metallic sheath separated by refractory material.

3. The stave/brick construction of claim 1 wherein each of the wear monitors is capable of being read using a time-domain reflectometer and/or time-domain reflectometry.

4. The stave/brick construction of claim 1 further comprising one or more thermocouples disposed through or adjacent to the stave and/or one or more of the bricks.

5. The stave/brick construction of claim 3 further comprising one or more thermocouples disposed through or adjacent to the stave and/or one or more of the bricks.

6. The stave/brick construction of claim 5 wherein the plurality of bricks at least partially disposed in the plurality of channels form a plurality of stacked, substantially horizontal rows of bricks protruding from the front face of the stave.

7. The stave/brick construction of claim 6 wherein one of the bricks cannot be pulled and/or rotated out of the first opening of its respective channel when another brick is disposed in the row above and partially or completely covers the one brick.

8. The stave/brick construction of claim 5 comprising a plurality of staves standing side-by-side with gaps between adjacent staves;

wherein each stave has a plurality of ribs, a plurality of channels, and a plurality of substantially horizontal rows of bricks disposed in the plurality of channels.

9. The stave/brick construction of claim 8 wherein the plurality of substantially horizontal rows of bricks disposed in the plurality of channels covers, in-whole or in-part, the gaps between adjacent staves.

10. The stave/brick construction of claim 5 further comprising a laser emitter/receiver for taking readings by emitting one or more laser pulses onto the stave and/or plurality of bricks and for receiving the one or more laser pulses as reflected from the stave and/or plurality of bricks, and a computer for analyzing the reflected laser pulses to determine one or more conditions of the stave and/or plurality of bricks and/or differences in the one or more conditions of the stave and/or plurality of bricks between first and second readings.

11. The stave/brick construction of claim 7 further comprising a laser emitter/receiver for taking readings by emitting one or more laser pulses onto the stave and/or plurality of bricks and for receiving the one or more laser pulses as reflected from the stave and/or plurality of bricks, and a computer for analyzing the reflected laser pulses to determine one or more conditions of the stave and/or plurality of bricks and/or differences in the one or more conditions of the stave and/or plurality of bricks between first and second readings.

12. The stave/brick construction of claim 9 further comprising a laser emitter/receiver for taking readings by emitting one or more laser pulses onto the stave and/or plurality of bricks and for receiving the one or more laser pulses as reflected from the stave and/or plurality of bricks, and a computer for analyzing the reflected laser pulses to determine one or more conditions of the stave and/or plurality of bricks and/or differences in the one or more conditions of the stave and/or plurality of bricks between first and second readings.

13. The stave/brick construction of claim 5 wherein the rotation of the brick comprises a bottom of the brick moving in a direction towards the stave.

14. The stave/brick construction of claim 5 wherein the stave is substantially flat.

15. The stave/brick construction of claim 5 wherein the stave is curved with respect to one or both of a horizontal axis and a vertical axis.

16. The stave/brick construction of claim 1 wherein each of the plurality of bricks comprises an oblique top section and an oblique bottom section, wherein each of the oblique top and bottom sections protrude from the face of the stave.

17. The stave/brick construction of claim 16 wherein the oblique top and bottom sections are substantially parallel.

18. The stave/brick construction of claim 16 wherein the plurality of bricks at least partially disposed in the plurality of channels form a plurality of stacked, substantially horizontal rows of bricks protruding from the front face of the stave; and wherein the oblique top section of one brick is disposed substantially near, adjacent to, in partial contact with or in complete contact with the oblique bottom section of another brick immediately above the one brick.

19. The stave/brick construction of claim 6 wherein the plurality of bricks comprise exposed faces that define a flat or uneven surface.

20. A stave/brick construction, comprising:

a plurality of staves standing side-by-side defining gaps between adjacent staves, wherein each stave has a plurality of ribs and a plurality of channels, wherein a front face of each stave defines a first opening into each of the channels, wherein each stave is curved with respect to one or both of a horizontal axis and a vertical axis;

a plurality of bricks wherein each brick is insertable into one of the plurality of channels via its first opening to a position, upon rotation of the brick, partially disposed in the one channel such that one or more portions of the brick at least partially engage one or more surfaces of the one channel and/or of a first rib of the plurality of ribs whereby the brick is locked against removal from the one channel through its first opening via linear movement without first being rotated;

wherein the plurality of bricks at least partially disposed in the plurality of channels form a plurality of stacked, substantially horizontal rows of bricks protruding from the front face of each stave and wherein the plurality of substantially horizontal rows of bricks disposed in the plurality of channels covers, in-whole or in-part, the gaps between adjacent staves;

one or more wear monitors, wherein each wear monitor is disposed through or adjacent to the stave and/or one or more of the bricks and wherein each of the wear monitors may be read using a time-domain reflectometer and/or time-domain reflectometry; and one or more thermocouples disposed through or adjacent to the stave and/or one or more of the bricks.

21. The stave/brick construction of claim 20 further comprising a laser emitter/receiver for taking readings by emitting one or more laser pulses onto the staves and/or plurality of bricks and for receiving the one or more laser pulses as reflected from the staves and/or plurality of bricks, and a computer for analyzing the reflected laser pulses to determine one or more conditions of the staves and/or plurality of bricks and/or differences in the one or more conditions of the staves and/or plurality of bricks between first and second readings.

* * * * *